United States Patent [19]

Topholm

[11] Patent Number: 4,550,227

[45] Date of Patent: Oct. 29, 1985

[54] IN-THE-EAR HEARING AID

[75] Inventor: Christian Topholm, Vaerloese, Denmark

[73] Assignee: Topholm & Westermann I/S, Vaerloese, Denmark

[21] Appl. No.: 629,017

[22] Filed: Jul. 9, 1984

[30] Foreign Application Priority Data

Aug. 16, 1983 [DE] Fed. Rep. of Germany ..... 3329473

[51] Int. Cl.[4] ..... H04R 25/02

[52] U.S. Cl. ..... 179/107 E; 381/69

[58] Field of Search ..... 179/107 E, 107 R; 381/68, 69

[56] References Cited

U.S. PATENT DOCUMENTS 3,684,830 8/1972 MacIagan et al. ..... 179/107 R 4,471,490 9/1984 Bellafiore ..... 179/107 E

*Primary Examiner*—Gene Z. Rubinson

*Assistant Examiner*—Danita R. Byrd

*Attorney, Agent, or Firm*—Sughrue, Mion, Zinn, Macpeak and Seas

[57] ABSTRACT

A hearing aid which can be worn in the ear concha and which contains a microphone, an amplifier, an earphone, a battery and a connection to an ear adapter. All components are mounted in a flat, cylindrical housing (1), whose cover (2) can be rotated around a hollow shaft (6) which acts as the sound inlet channel (4), actuates the on/off switch (8, 9) and carries on its inner side at least one wiper (11) which, in contact with at least one resistive strip (10), acts as a volume control.

9 Claims, 4 Drawing Figures

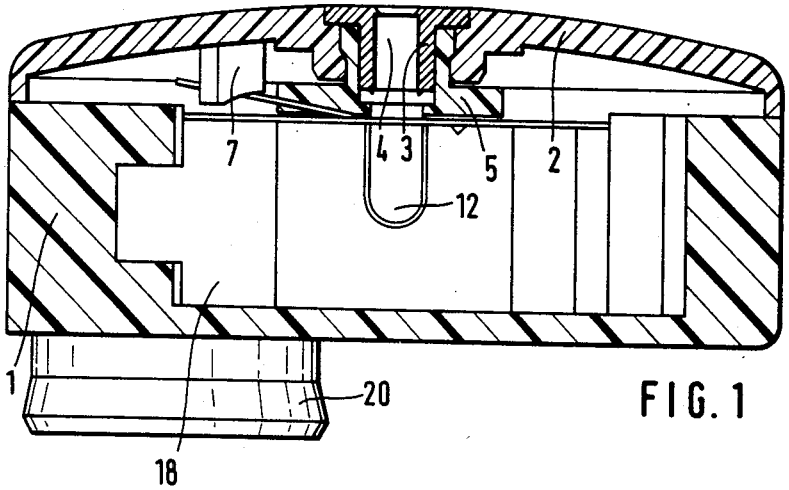
FIG. 1
FIG. 2
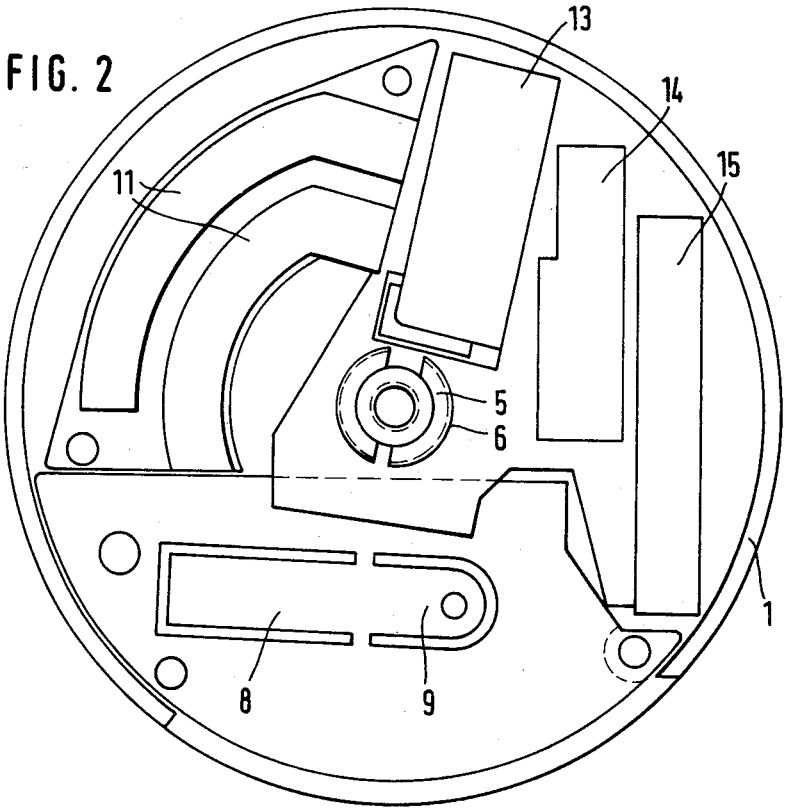

IN-THE-EAR HEARING AID

BACKGROUND OF THE INVENTION

The invention concerns an In-the-ear hearing aid for persons with impaired hearing which contains microphone, amplifier, earphone, battery and a connector for an ear adapter.

In the development of hearing aids, the general trend was away from the "box" type unit towards units which can be worn behind the ear, in the ear, or combined with or integrated in frames of spectacles. During all of these developments, the increasing miniaturization of components was always utilized to improve and/or miniaturize the devices in many ways, but there was always the feeling that this is a prosthetic device which ought to be kept hidden.

More recent developments led to hearing aids which are so small that the complete device can be worn in the cavity (concha) which is formed by the various parts of the external ear.

The first devices of this type were manufactured by taking a casting of the external ear to form a hollow, so-called ear mold which matched the ear of the future wearer and which was equipped with a sound channel which projected slightly into the auditory channel. After this, the components of the device were installed in this ear mold which was then fitted with a cover. Such individual production made manufacture both time-consuming and costly.

It is already known that the manufacture of simple and cheap hearing aids in the external ear can be achieved by installing the components in a housing which is shaped such that it fits reasonably well into the concha of a normal ear. This housing device is then fitted into a recess in an ear casting which can either be made individually or can be a standard version which approximately fits most ears. Hearing aids of this type naturally have an unpleasant apperance and it is necessary to manufacture two different types for left and right ears.

Such a device can be used by the hearing aid specialist only with certain restrictions.

SUMMARY OF THE INVENTION

The object of this invention was thus to create the smallest possible, virtually unnoticeable hearing aid which could be used for both the right and left ear and which, in spite of its small size, contained all necessary parts, including the battery, required for the hearing aid, which was simple to operate, and which was easy to fit into the ear.

It is clear that these requirements are to some degree contradictory. Space for the battery, which must have a minimum standard size if its operating lifetime is to be of a reasonable length, requires a certain minimum size of the hearing aid. Operating controls and connections to an ear adapter, which should be made to match the ear as the position of the inlet to the auditory channel differs from one ear to another, are equally important. It would therefore be desirable to implement all these requirements in a particularly unnoticeable unit which could be fitted in the lower part of the concha, approximately between the tragus and antitragus.

This is achieved in a hearing aid which is worn directly in the concha, by installing all components in a flat, cylindrical housing whose cover can be rotated around a hollow shaft which acts as the sound inlet channel, actuates the on/off switch and carries on its inner side at least one wiper which in contact with at least one resistive strip, acts as a volume control.

Preferably, the arrangement should be such that two resistive strips and two wipers are provided, that the cover carries a projection on its inner side which acts as an end stop and switching cam for the on/off switch, and that battery contact springs which can be actuated by the switching cam are provided on the upper side of the battery compartment.

BRIEF DESCRIPTION OF THE DRAWINGS

In the following sections, the invention is described with the aid of an exemplary construction together with the enclosed drawings.

In the drawings:

FIG. 1 Shows an enlarged sectional view through a hearing aid in accordance with the invention;

FIG. 2 Shows an enlarged schematic top view of the hearing aid;

DETAILED DESCRIPTION OF THE PREFERRED EMBODIMENTS

The difficulties which had to be overcome in the design of the new hearing aid became apparent when the actual dimensions of the device are considered. With a diameter of approximately 16 mm and a maximum height of approximately 7 mm, and with a battery diameter of approximately 8 mm, it was obviously not possible to mount the operating controls on the exterior of the housing. On the other hand, the battery, switch, volume control plus acoustic pressure control, microphone, amplifier and earphone had to be arranged in an acceptable manner, and it must be possible to operate the device without using tweezers. It is clear that these requirements were not easy to fulfill.

Figure 3:
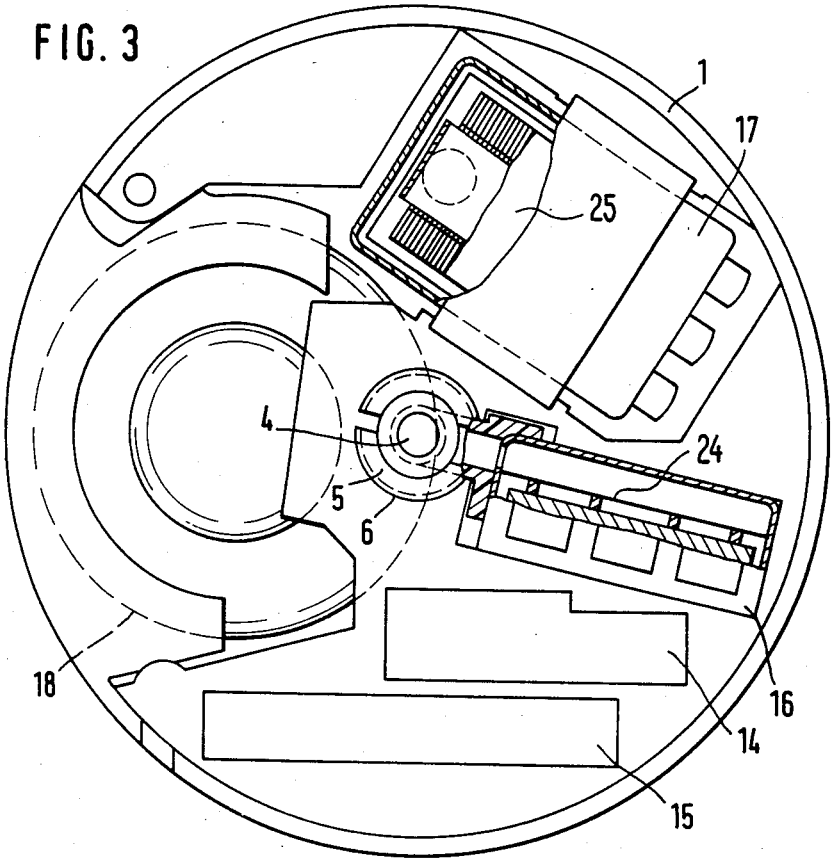
FIG. 3 Shows an enlarged view in another plane.

In FIGS. 1 to 3, it is possible to see the cylindrical housing 1 with a flat, slightly convex cover 2 with a sealing sleeve 3 inserted from the top, which defines a sound inlet opening 4. This sealing sleeve is pressed into the hollow center shaft 5, which has a diametrical slit and is slightly spread by insertion of the sleeve, fixing the cover to the shaft 5 such that it can be turned. This prevents removal of the cover, but permits it to be turned. This is necessary, as all operating functions have to be achieved exclusively with the rotation of the cover. The inner side of the cover carries a cam 7, which cooperates with the battery contact springs 8 and 9 for closing and opening the resulting switch. This cam 7 also acts as a stop to limit the rotary motion of the cover 2. Cover 2 also carries two wiper springs 10 which, in the preferred form, are attached by means of a common contact ring and small projections to the hub of cover 2. These wiper springs are in contact with two resistive strips 11, one of which acts as a volume control and the other as an acoustic pressure control. This makes it possible, even in this small device, to simultaneously reduce the acoustic pressure when the volume is reduced, a feature which is currently possible only with considerably larger devices.

A further important characteristic is the sound inlet opening 4 in the center of the cover and the hollow center shaft which has a slot 12 in its center part into which a sound channel leading to the microphone is inserted.

As can be seen from FIG. 2, the housing contains a space 13 for a microphone, a space 14 for electrical components for the amplifier and a space 15 for the amplifier itself. The microphone 16 is shown in FIG. 3 as is the earphone 17. The planes of the membranes 24, 25 of the microphone and of the earphone, respectively, are approximately at right angles to each other.

Furthermore, the battery compartment 18, a battery 19, and a connection piece 20 defining a sound outlet aperture for an ear adapter can be seen.

It can be seen that in the version in accordance with FIG. 1, the connection piece 20 is arranged eccentrically or off-center. This is again of particular importance, particularly because the housing 1 is rotationally symmetrical, which means that it is not necessary to orient the housing in any particular direction with respect to the concha.

For fitting, the device is first inserted in the concha without an ear adapter and turned until the sound outlet aperture is as close as possible to the inlet of the auditory channel. This position is then recorded. The counter part of a sound channel which can be inserted into the connection piece is then molded into the subsequently manufactured ear adapter. For cleaning out the ear adapter, it can be easily disconnected from the hearing aid.

Normally, such an ear adapter has a coupling ring into which a circular spring or a circular wire or a rubber ring is cast such that the sound outlet aperture of the hearing aid can be locked into the ear adapter.

The extremely small dimensions of the new hearing aid mean, however, that the corresponding ear adapter is correspondingly smaller, which means that this normal connection is probably no longer possible.

Figure 4:
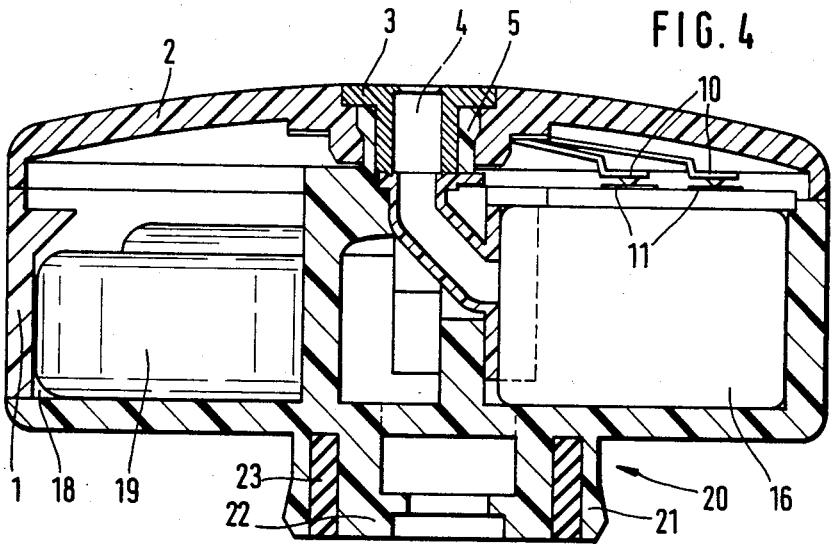
FIG. 4 Shows an enlarged sectional view of a further form of the hearing aid.

In the FIG. 4 embodiment, the locking mechanism has been transferred to the sound output opening, while the ear adapter has only a cast ring without a spring. The newly designed sound outlet aperture therefore has a thin external wall 21, which is thickened slightly towards the bottom and which can be deflected when the ear adapter is fitted. Between this outer, thin wall and the inner tube 22, there is a cylindrical hollow space which is filled with a rubbery material 23. This rubbery material prevents possible disadvantageous effects on the acoustic characteristics of the device which could result from this type of coupling. The acoustic hose leading to the earphone is then clamped into the inner tube 22.

With this newly designed sound outlet aperture, it is also possible to securely lock the hearing aid to even very small ear adapters.

As the new hearing aid is small and can be worn hidden in the lower part of the concha, and as all operating elements can be actuated with the aid of the cover, the aim of fulfilling the apparently contradictory requirements has been sucessfully achieved.

I claim:

1. An in-the-ear hearing aid for persons with impaired hearing, comprising: a generally flat cylindrical housing (1) adapted to be worn directly in the concha including a microphone, an amplifier, an earphone, a battery and a connector for an ear adapter, a cover (2) for said housing rotatable around a hollow shaft (5, 6) defining a sound inlet channel (4); said cover actuating an on/off switch (8, 9) and carrying, on an inner side thereof, at least one wiper (10) which, in contact with at least one resistive strip (11), which defines a volume control.

2. An in-the-ear hearing aid in accordance with claim 1, wherein two resistive strips (11) and two wipers (10) are provided.

3. An in-the-ear hearing aid in accordance with claim 1, wherein the cover (2) carries a projection (7) on said inner side which acts as an end stop and operates as a switching cam for the on/off switch.

4. An in-the-ear hearing aid in accordance with claim 3, wherein an upper surface of a battery compartment (18) carries battery contact springs (8, 9) which can be actuated by the switching cam (7).

5. An in-the-ear hearing aid in accordance with claim 1, wherein the hollow shaft (5, 6) consists of one part rigidly connected to the housing, and a sleeve (3) inserted through the cover from the outside, and wherein the part connected to the housing has an outlet opening (12) on a side leading to the microphone.

6. An in-the-ear hearing aid in accordance with claim 5, wherein the hollow shaft (5, 6) has diametrically opposite axial slits dividing said hollow shaft into halves, said sleeve being in clamped engagment with the two halves and the cover.

7. An in-the-ear hearing aid in accordance with claim 1, wherein membranes of the microphone and the earphone are aligned approximately orthoganally.

8. An in-the-ear hearing aid in accordance with claim 1, wherein a sound outlet aperture (20) is mounted eccentrically on a lower side of the housing opposite the cover.

9. In-the-ear hearing aid in accorcance with claim 8, wherein the sound outlet aperture comprises an outer, relatively thin wall (21), an inner tube (22) for connection to the earphone, and an intermediate, cylindrical hollow space which is filled with a rubbery material (23).

* * * * *